US007798111B2

(12) United States Patent
Kleiber et al.

(10) Patent No.: US 7,798,111 B2
(45) Date of Patent: Sep. 21, 2010

(54) CAMSHAFT ADJUSTER FOR AN INTERNAL COMBUSTION ENGINE

(75) Inventors: Thomas Kleiber, Wahlschied (DE); Rainer Ottersbach, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 582 days.

(21) Appl. No.: 11/722,540

(22) PCT Filed: Nov. 12, 2005

(86) PCT No.: PCT/EP2005/012154

§ 371 (c)(1),
(2), (4) Date: Jun. 22, 2007

(87) PCT Pub. No.: WO2006/074744

PCT Pub. Date: Jul. 20, 2006

(65) Prior Publication Data

US 2008/0127921 A1 Jun. 5, 2008

(30) Foreign Application Priority Data

Dec. 23, 2004 (DE) ..... 10 2004 062 036

(51) Int. Cl.
*F01L 1/34* (2006.01)

(52) U.S. Cl. ..... 123/90.15; 123/90.17; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 5,845,615 | A * | 12/1998 | Nakamura et al. | 123/90.17 |
| 6,202,610 | B1 | 3/2001 | Yoshiki et al. | |
| 2002/0139330 | A1 | 10/2002 | Takahashi et al. | |
| 2005/0034693 | A1 | 2/2005 | Heintzen et al. | |
| 2005/0155567 | A1 | 7/2005 | Wierl et al. | |

FOREIGN PATENT DOCUMENTS

| | | |
|---|---|---|
| DE | 10211607 | 10/2003 |
| DE | 10335051 | 7/2004 |
| EP | 0848141 | 7/2002 |

* cited by examiner

*Primary Examiner*—Ching Chang
(74) *Attorney, Agent, or Firm*—Volpe and Koenig, P.C.

(57) ABSTRACT

A camshaft adjuster (1) for an internal combustion engine is provided, in which the relative angular position between a driving gear (2) and an output element that is allocated to the camshaft can be adjusted by hydraulically impinging pressure chambers located between an inner and outer rotor. The outer rotor and the gear ring of the driving gear (2) are joined to each other via fastening elements (15). In order to create a particularly compact camshaft adjuster (1), the fastening elements are located at least in part at a distance from the longitudinal axis of the camshaft adjuster (1) which is smaller than the external radius (35) of the pressure chambers.

11 Claims, 4 Drawing Sheets

X ---------- X

CAMSHAFT ADJUSTER FOR AN INTERNAL COMBUSTION ENGINE

BACKGROUND

The invention relates to a camshaft adjuster for an internal combustion engine according to the preamble of claim 1.

From DE 102 11 607 A1, a camshaft adjuster for adjusting and fixing the relative rotational angle position of a camshaft relative to the crankshaft of an internal combustion engine is known. A hydraulic adjustment device here consists of an external rotor, which is allocated to a drive wheel, and also an internal rotor, which is connected to a camshaft via a driven element. Pressure chambers are formed between the external rotor and the internal rotor. Charging these chambers hydraulically can change the angular relationship between the drive wheel and driven element.

In the mentioned publication, it is proposed to produce the drive wheel and at least one of the other functional parts integrally from a high load capacity plastic. According to a first embodiment, the drive wheel and the external rotor and also two other components are produced integrally from plastic. For an alternative construction, the external rotor is produced as a separate component from plastic or from a conventional material, such as metal, and is set in a cover formed integrally with the drive wheel.

The outer rotor, which forms the radially outer boundaries, as well as boundaries in the peripheral direction of the pressure spaces, is screwed to a cover, which surrounds the outer rotor with a hollow cylindrical peripheral surface and which has brackets projecting radially outwardly from the peripheral surface and connected to the toothed ring by means of screws passing through the brackets.

The invention is based on the objective of providing a camshaft adjuster, which is improved in terms of radial installation size and/or the hydraulic pressure charge.

SUMMARY

According to the invention, the objective is met by the features of the independent claim 1.

The invention is based on the knowledge that for a camshaft adjuster according to DE 102 11 607 A1, the radial installation size of the camshaft adjuster depends on the sum of the following dimensions:

- The radial installation size of the outer rotor or the radius of the radial boundary of the pressure spaces,
- The required radial installation space for the attachment elements and also the brackets of the outer rotor and optionally allocated brackets or flanges, which extend radially inwardly from the toothed ring, and also
- The radial dimension of the toothed ring and the associated components.

According to the invention, the mentioned sum is reduced in that the attachment elements are arranged at least partially at a distance from a longitudinal axis of the camshaft adjuster, which is smaller than an outer radius of the pressure spaces. In this way, the dimensions according to b) and c) are not summed. Instead, the dimensions related to b) and c) overlap, so that the total radial installation size is reduced.

The use of the knowledge according to the invention produces new shaping possibilities:

- For a given outer radius of the drive wheel required, for example, as a result of the gear transmission of the camshaft gearing, according to the invention the outer radius of the pressure spaces can be enlarged. For an unmodified hydraulic design, an inner radius of the pressure spaces can be enlarged, so that open installation space is produced in the camshaft adjuster radially on the inside. On the other hand, for a constant inner radius of the pressure spaces, the active surface for a hydraulic charge can be enlarged, whereby an improved adjustment effect and/or a reduced design of additional hydraulic components can be produced.
- For a constant outer diameter of the pressure spaces, the outer radius of the drive wheel can be reduced, whereby the radial installation size of the drive wheel and the camshaft adjuster can be reduced.
- Mixtures of the two mentioned alternatives are also possible, which produces expanded structural design possibilities and new installation space possibilities.

In the sense of the invention, attachment elements are understood to be attachment elements themselves, such as screws, rivet connections, or other positive or non-positive attachment elements, and also associated regions of the components to be connected, such as the flanges, brackets, or the like. According to the teaching according to the invention, the previously mentioned attachment elements are arranged at least partially in the radial direction at the height of the pressure spaces. Here, the attachment elements can be arranged at any position in the longitudinal direction of the camshaft adjuster and can be arranged arbitrarily over the peripheral direction.

According to a special construction of the invention, the attachment elements are arranged in the peripheral direction between pressure spaces and also in the direction of the longitudinal axis of the camshaft adjuster between axial boundaries of the pressure spaces. This construction is based on the knowledge that material clusters, which represent unused installation space and which cause additional weight in the outer rotor, are provided in the outer rotor between the pressure spaces in the peripheral direction according to the state of the art, whereby the mass moment of inertia of the camshaft adjuster is increased. According to the invention, this installation space can be advantageously used, in that the attachment elements are arranged within this space.

For this purpose, it can be advantageous according to an improvement of the invention if the outer rotor has radial bulges between adjacent pressure spaces, wherein the radial bulges mean material savings for the outer rotor and simultaneously create the installation space for the attachment elements. Radially inwardly oriented brackets, which can be connected rigidly to the toothed ring of the drive wheel, project into the radial bulges.

The invention is further based on the knowledge that for an embodiment of DE 102 11 607 A1, between the outer rotor and inner rotor, a bearing surface is formed with plastic, which is not optimum both for a contact partner made from metal and also for such an element made from plastic in terms of bearing properties, sliding properties, and wear as well as operational strength. For example, if a plastic in the form of a duroplastic is used for an external rotor, then it has been shown that such duroplastics can contain minerals. These minerals lead to increased wear and increased friction on sliding surfaces, also those made from steel, and in the worst case to failure of the camshaft adjuster. On the other hand, it has been shown for a second embodiment of DE 102 11 607 A1 that a use of a metallic bearing surface requires an additional mounting step, in some circumstances unnecessarily, in a surrounding plastic body. Furthermore, through such a placement, under some circumstances another degree of freedom or play and production inaccuracy for the bearing surface is produced, which can negatively affect the operation of the camshaft adjuster.

Therefore, according to the invention the bearing surface of the external rotor is formed with a metallic insert body, which is held with a non-positive fit in a carrier body made from plastic. Through this non-positive hold, the undesired degrees of freedom, play, and unnecessary mounting steps can be avoided. Nevertheless, according to the invention a metallic insert body can be used, so that a metallic bearing surface is given, whereby the increased wear and increased friction on the sliding surfaces can be avoided. The carrier body according to the invention can involve either the drive wheel itself or another component, such as a flange, which is connected to the drive wheel via corresponding attachment elements with a friction, positive, and/or firmly bonded fit, possibly under the intermediate connection of additional components.

According to one improvement of the invention, the insert body is constructed extending in the peripheral direction and also forms a limit for the pressure spaces in addition to the bearing surface. Accordingly, the insert body has a multifunction construction with the function of the bearing and the operating-fixed shape of the pressure spaces. Here, the insert body can limit the pressure spaces radially outwards and/or in the peripheral direction and, under some circumstances, can form limits or stops for the internal rotor. Through the formation of the insert body running in the peripheral direction, a rigid, closed ring structure is formed. In addition, the insert body thus correlates the position and orientation of several pressure spaces distributed over the periphery.

In one preferred camshaft adjuster according to the invention, the drive wheel is produced from a composite material. In the sense of the invention, a composite material is understood to be a material containing several sub-materials. These sub-materials can be formed, for example, as a carrier material with reinforcement elements arranged in the carrier material. The material can involve a fiber-composite material or a body formed from different layers of different materials. Examples here can be thermoplastics or duroplastics or materials made from thermoplastics and duroplastics together. In this way, according to the material selection and material combination, the mechanical properties of the drive wheel can be influenced in a suitable way.

According to another aspect of the invention, the internal rotor is also formed with plastic. The internal rotor has at least one bearing surface made from metal connected to this rotor with a firmly bonded fit. Accordingly, advantages known for a construction made from plastic and named, for example, in DE 102 11 607 A1 can be used for the rotor. In addition, both the internal rotor and also the external rotor have bearing surfaces made from metal, which has proven advantageous in terms of sliding properties and operating strength.

For the case that the attachment elements are not to interact with the material of the drive wheel or the flange otherwise used, it is advantageous when the attachment elements interact with reinforcement inserts of the drive wheel and/or the flange. Such reinforcement inserts can involve, for example, metal intermediate layers such as inserts, which are supported, for example, with their casing surface opposite the other material of the drive wheel or the flange while guaranteeing good a force introduction. Possible receptacle recesses of the reinforcement inserts can be shaped selectively for connecting to the attachment elements. For example, they can be inserted into the threading, with which the attachment elements are screwed. In this way, an especially compact construction of the camshaft adjuster is allowed for simultaneously good force introduction and transmission.

For a further improved camshaft adjuster, insert bodies and carrier bodies are connected to each other with a positive fit by means of an injection molding process. Accordingly, the insert bodies can be used in addition to their functions in operation during the production as shaping surfaces for an injection molding process, in that injection molding is performed on this material. The injection molding process simultaneously guarantees an especially good positive-fit connection between the contact body and carrier body.

Furthermore, the toothed ring can be formed in one piece with the brackets and with a composite material, wherein a reinforcing material of the composite material is arranged in the region of the brackets. In this way, the mechanical properties of the brackets can be improved.

BRIEF DESCRIPTION OF THE DRAWINGS

Additional features of the invention emerge from the following description and the associated drawings, in which embodiments of the invention are presented schematically. Shown are.

DETAILED DESCRIPTION OF THE PREFERRED EMBODIMENTS

Figure 1:
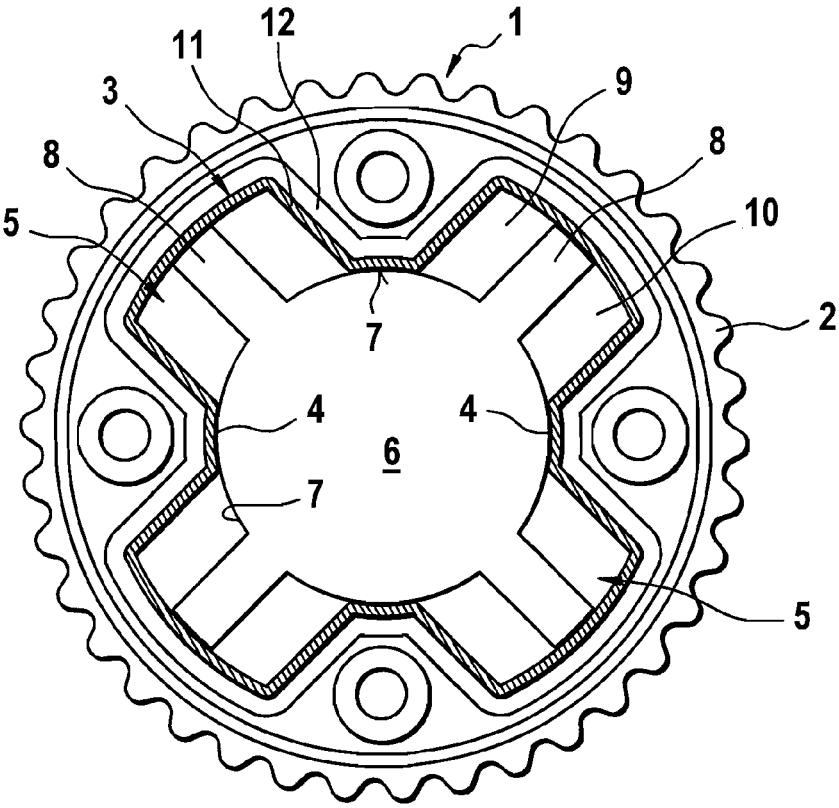
FIG. 1 a cross-sectional view of a part of a camshaft adjuster with an outer rotor and a carrier body made from plastic with a firmly bonded fit connected insert body and also an inner rotor supported rotatably in the outer rotor.

The invention relates to a hydraulic camshaft adjuster 1 in a known construction. The camshaft adjuster has a drive wheel 2, which is formed as a pulley in the shown embodiments. An outer rotor 3, which is arranged, in particular, radially inwardly from the drive wheel 2, is connected rigidly to the drive wheel 2. The outer rotor 3 is formed with bearing surfaces 4, which correspond to segments of a casing surface of a cylinder, and also radial bulges for pressure chambers 5. According to the embodiment shown in FIG. 1, four bearing surfaces 4 and also four pressure chambers 5 are provided, which are distributed uniformly over the periphery. An inner rotor 6, which can be locked or is locked in rotation with the camshaft, is arranged in the outer rotor 3 so that it can rotate relative to this outer rotor about a longitudinal axis of the camshaft adjuster 1. The inner rotor 6 has bearing surfaces 7 formed corresponding to the bearing surfaces 4 of the outer rotor 3 and also has vane-like radial projections 8, wherein four bearing surfaces 7 and four projections 8 are provided, which are distributed uniformly across the periphery of the inner rotor, according to the embodiment shown in FIG. 1. The bearing surfaces 4 and 7 form a seal in the peripheral direction and the end faces of the projections 8 contact the associated pressure chambers 5 forming a seal radially on the outside, so that in the peripheral direction pressure spaces 9, 10 are formed on both sides of the projections. Through suitable charging of the pressure spaces 9, 10, the relative angular position between the outer rotor 3 and the inner rotor 6 can be changed, whereby the angular relationship between the drive wheel 2 and a camshaft can be changed for adjusting the opening times of valves.

According to FIG. 1, both the pressure chambers 5 and also the bearing surfaces 4 are both formed with a metallic insert body 11, which extends in the peripheral direction and which has an approximately constant wall thickness. The insert body 11 is held with a firmly bonded fit in a carrier body 12, which according to the embodiment shown in FIG. 1 is formed integrally with the drive wheel 2 or is formed as a separate component, which can be connected rigidly to the drive wheel 2.

Figure 2:
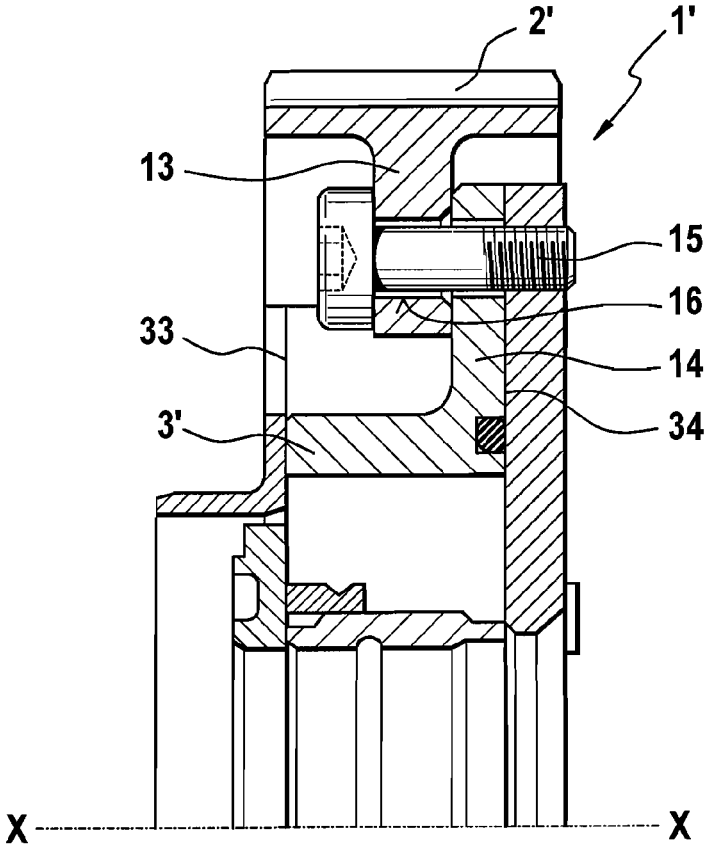
FIG. 2 a half longitudinal cross-sectional view of a camshaft adjuster in which the drive wheel made from plastic or an attachment element is attached to a flange.
Figure 3:
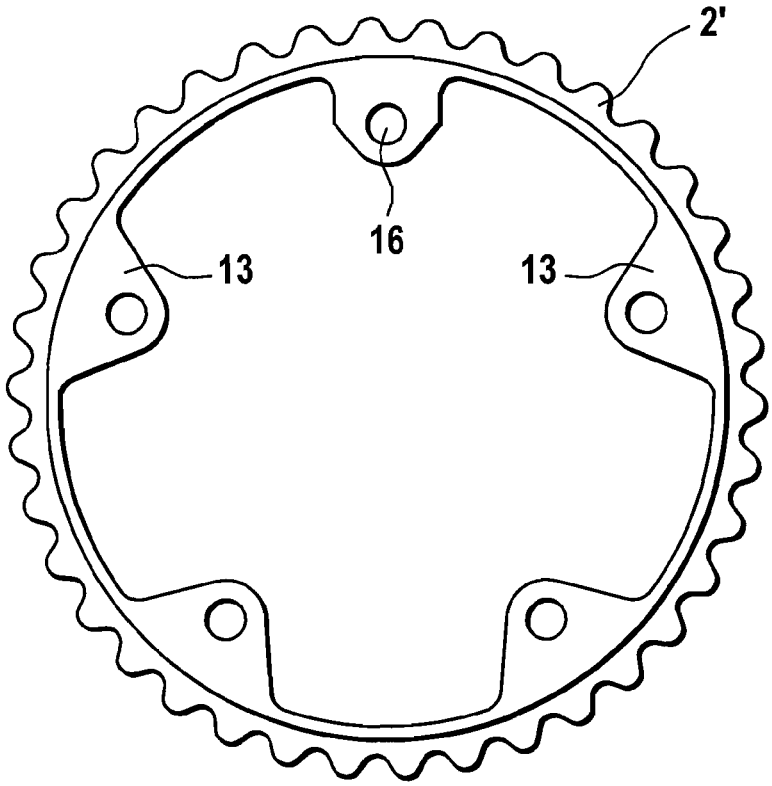
FIG. 3 a view of a drive gearwheel made from plastic with radially inwardly pointing brackets for receiving attachment elements.
Figure 4:
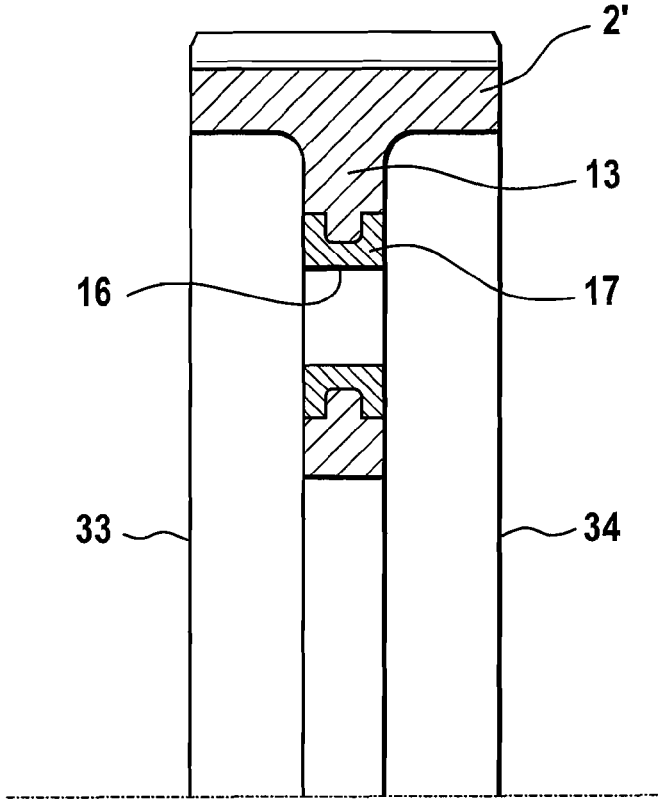
FIG. 4 a half longitudinal cross-sectional view of a drive wheel with a connecting piece or a bracket and inserts inserted into the connecting piece or bracket.
Figure 5:
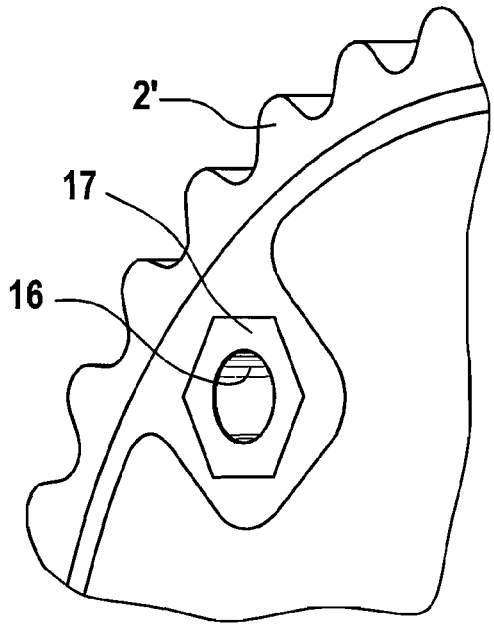
FIG. 5 a partial cross-sectional view of a drive gearwheel with radially inwardly pointing brackets and inserts arranged in these brackets.

FIG. 2 shows a camshaft adjuster 1' in longitudinal section. For this camshaft adjuster, the drive wheel 2' is formed integrally with inwardly projecting brackets 13, which are arranged approximately in the middle in the axial direction, which extend in the direction of a longitudinal axis X-X of the camshaft adjuster 1' over one third to one fourth of a width of the running gearing of the drive wheel 2', and which are distributed uniformly over the periphery, cf. FIG. 3. A flange 14, which is formed integrally with the outer rotor 3', contacts an end of the brackets 13. The brackets 13 and the flange 14 are connected to each other with a friction, positive, and/or firmly bonded fit and/or via attachment elements 15, which are formed as screws according to FIG. 2. Here, the brackets 13 and also the flange 14 have suitable bores 16 with or without threading. The bores 16 with or without threading can here be formed directly in the material forming the drive wheel or are prepared according to FIG. 4 by reinforcement intermediate layers 17, especially inserts, for example, made from metal, which are attached preferably with a firmly bonded fit to the other integral elements of the drive wheel 2.

In terms of the drive wheel 2, the outer rotor 3, the bearing surface 4, the inner rotor 6, the bearing surface 7, the projections 8, the insert body 11, the carrier body 12, the brackets 13, and/or the flange 14, there are the following shaping possibilities:

- The components named above can be made from any plastic or from a fiber composite material. In particular, a thermoplastic or a duroplastic of any composition can be used.
- Furthermore, any composite material can be provided, for example, a plastic with an iron metal or a non-iron metal. In terms of the thermal expansion coefficients, these can be adapted to each other mutually, so that, for example, plastic, fiber composite materials, or composite materials have equal thermal expansion coefficients, such as adjacent components made from different materials. In particular, components arranged on the driven side, that is, components connected rigidly to the camshaft, can have a greater thermal expansion coefficient than components arranged on the drive side.
- The components named above can be joined to form units in one or more pieces. For example, the drive wheel 2, the outer rotor 3, the bearing surface 4 with insert body 11, bracket 13, and carrier body 12, as well as flange 14 are formed as an integral, installation space-optimized component made from one or more materials or composite materials.
- For weight reduction and for improving the mounting possibilities, pockets can be provided in the components named above.
- The drive wheel 2 and insert body 11 can be connected to each other optionally through the intermediate connection of additional (sub) bodies with a positive fit, for example, by screws, with a form fit, for example, by rivets, or with a firmly bonded fit, for example, by adhesive, injection molding, or integral production, wherein combinations of the connection possibilities named above are conceivable.
- Non-plastic elements can be used as aids for the screw connection, for example, based on a "mold-in" or "after-molding" technology. A "mold-in" technology involves, for example, a metal bushing with threading, which is injection molded in a die, while as an example for an "after-mold" technique, a metal bushing with threading is conceivable, which is inserted in a plastic part after the injection-molding process.
- Metallic elements or sub-bodies can be formed as reinforcement material in other materials, for example, for homogenizing the expansion and/or for bracing, for forming support material, and for increasing the component stiffness.
- A selection of materials and their orientation can be used as thermal construction parameters, in which the expansion coefficient can be set to a desired target according to the element and its volume percentage.
- The use of reinforcement intermediate layers or inserts can be used, in particular, for minimizing setting force losses and for permitting direct screw connections.
- According to FIG. 1, the outer rotor can be embedded directly into a plastic material. Assembling this plastic material with the outer rotor can be realized directly, for example, in an injection molding process or else by means of a later assembly.

Figure 6:
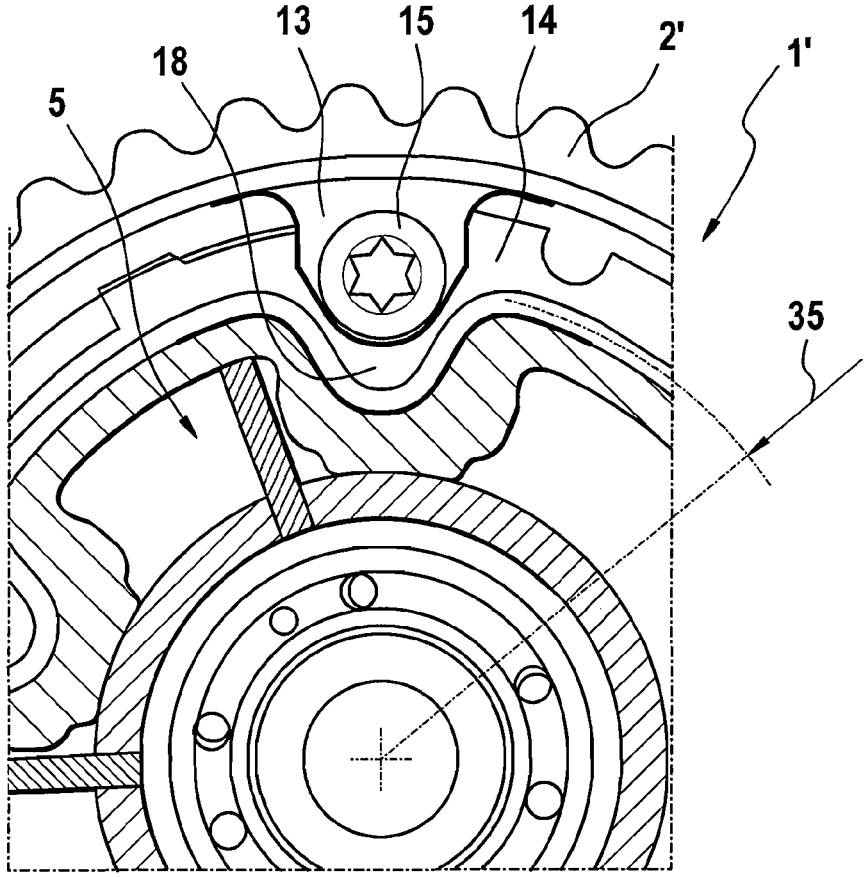
FIG. 6 a cross-sectional view of a camshaft adjuster, wherein attachment elements are drawn radially inwardly, so that their spacing from the longitudinal axis of the camshaft adjuster is smaller than the outer diameter of the pressure chambers, and FIG. 7 a view of a drive gearwheel made from plastic, which is attached to a housing of the camshaft adjuster via a carrier element.

FIG. 6 shows a partial cross section allocated to the embodiment according to FIG. 2. Here, the casing surface of the outer rotor 3 with the pressure spaces 5 has a back-and-forth or meander-shaped construction with different radii, wherein, in the region of the pressure spaces 5, the outer radius is at a maximum and the radius is reduced in the peripheral region between adjacent pressure spaces 5 through radial bulges or recesses 18. The brackets 13, which are connected to the toothed ring 19 rigidly or with a firmly bonded fit, project into the recesses 18 and are connected to the outer rotor 3 in the region of the recesses 18. In this way, the attachment elements 15 can be "pulled down" to smaller radii, so that the attachment elements 15 act at a radius that lies in the region of the outer diameter 35 of the pressure chamber 5 or that is smaller than this. Here, the attachment elements 15, the brackets 13, an optional flange 14, and the recesses 18 are provided preferably axially between the end faces 33, 34 of the drive wheel 2 or corresponding end faces of the pressure spaces 5, so that a small axial installation size is also produced.

Figure 7:
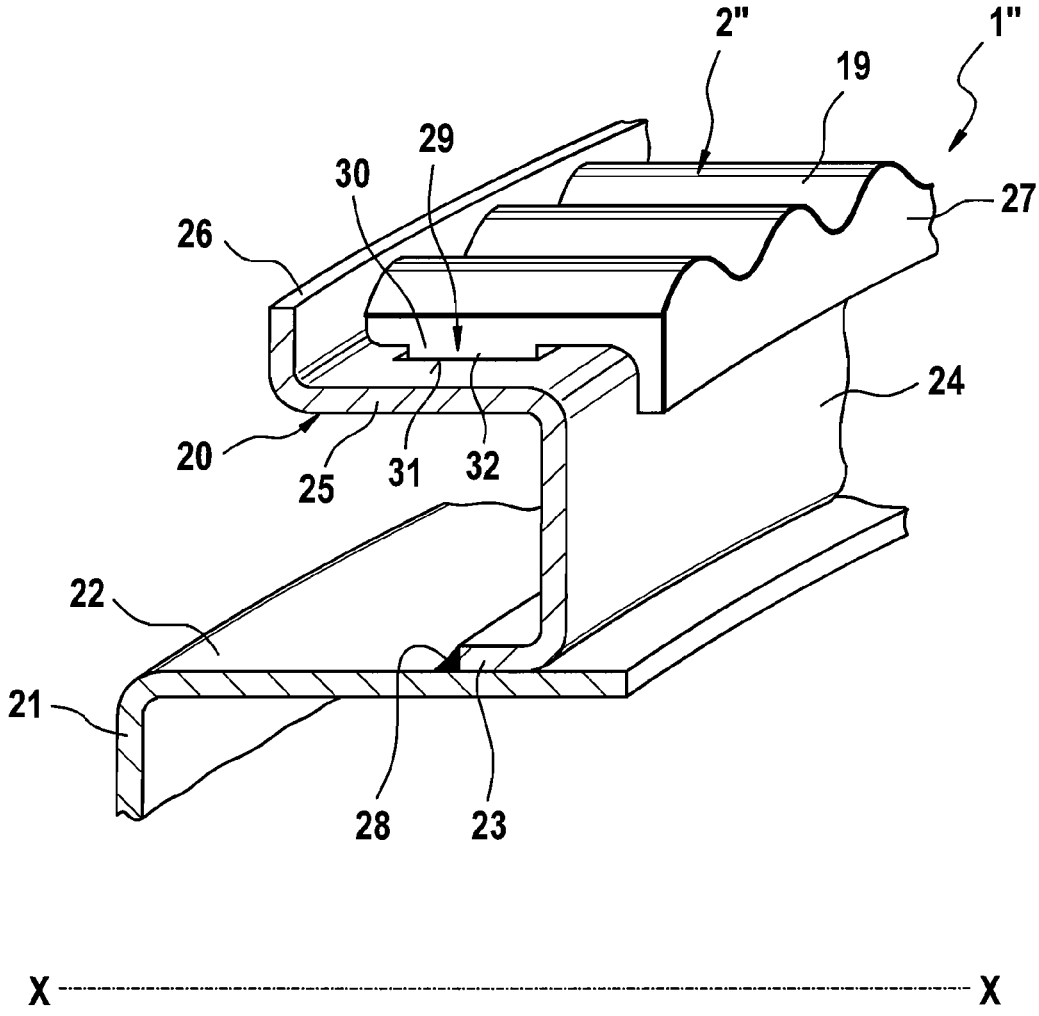

FIG. 7 shows an example construction for a drive wheel 2" with allocated components, here a toothed ring 19, a carrier element 20, and a housing 21.

The housing 21 is formed especially as a sheet-metal part with an approximately cylindrical casing surface 22 and includes additional components of the camshaft adjuster 1". The carrier element 20 is supported rigidly on the casing surface 22, especially by a firmly bonded connection. Here, the carrier element 20 has a hollow cylindrical contact connecting piece 23, which contacts the casing surface 22 radially at the inside and is connected to the housing 21 with a firmly bonded fit on at least one axial end face. The contact connecting piece 23 transitions, especially under the intermediate connection of a transition radius, into a circular disk-shaped carrier body 24, which is oriented coaxial to the longitudinal axis X-X and which, in turn, transitions in a hollow cylindrical outer body 25 with a surrounding shoulder 26 or collar in the end region opposite the carrier body 24.

The toothed ring 19 contacts the shoulder 26 in the region of an axial end face, while the opposite end of the toothed ring 19 has a radially inwardly projecting radial projection 27, which contacts the carrier body 24 or the transition region between the carrier body 24 and outer body 25. The toothed ring 19 has radially on the inside, especially approximately in the middle, a surrounding projection or connection region 29 provided across sub-peripheries, which extends approximately over half the width of the toothed ring 19. The connection region 29 is connected to the outer casing surface of the outer body 25 with a firmly bonded fit.

For the toothed ring 19, the carrier element 20, and the housing 21, all of the previously mentioned materials or material combinations can be used. As an example embodiment, a production of the toothed ring 19 from plastic, especially a duroplastic, is conceivable, while the carrier element 20 and the housing 21 are produced from a metal.

The shoulder 26 can be used alternatively or additionally for simplifying the mounting of a guide of a drive element like a toothed belt or a control chain in the direction of the longitudinal axis X-X.

The outer body 25 has on its outer casing surface preferably recesses 31 or depressions or grooves, which can be formed as pockets in the outer body or can pass through this body. For the shown embodiment, the recesses 31 are formed with an approximately rectangular cross section. Radially inwardly oriented projections 32 or a surrounding collar extend radially inwardly from the toothed ring 19, especially from the projection 30. These projections are held with a positive fit at least in the longitudinal direction X-X and/or in the peripheral direction in the recess 31, depression, or groove. In the radial direction, the toothed ring 19 can be guided opposite the carrier element 20 through the projection 30 and/or projection 32.

LIST OF REFERENCE SYMBOLS

1 Camshaft adjuster
2 Drive wheel
3 Outer rotor
4 Bearing surface of outer rotor
5 Pressure chamber
6 Inner rotor
7 Bearing surface of inner rotor
8 Projections
9 Pressure space
10 Pressure space
11 Insert body
12 Carrier body
13 Bracket
14 Flange
15 Attachment element
16 Bore
17 Reinforcement insert
18 Recess
19 Toothed ring
20 Carrier element
21 Housing
22 Casing surface
23 Contact connecting piece
24 Carrier body
25 Outer body
26 Shoulder
27 Projection
28 First connection region
29 Second connection region
30 Projection
31 Recess
32 Projection
33 Axial end face
34 Axial end face
35 Outer radius of pressure chamber

The invention claimed is:

1. A camshaft adjuster for an internal combustion engine, comprising a drive wheel and a driven element in which a relative angular relationship between the drive wheel and the driven element, which is allocated to a camshaft, is adjustable through hydraulic charging of pressure spaces between an outer rotor and an inner rotor thereof, wherein the outer rotor and a toothed ring of the drive wheel are connected to each other via attachment elements arranged at least partially at a distance from a longitudinal axis of the camshaft adjuster, which is smaller than an outer radius of the pressure spaces; and the outer rotor has recesses between adjacent ones of the pressure spaces, and radially inwardly oriented brackets rigidly connected to the toothed ring of the drive wheel project into the recesses and are connected to the outer rotor via the attachment elements in a region of the recesses.

2. The camshaft adjuster according to claim 1, wherein the attachment elements are arranged in a peripheral direction between pressure spaces.

3. The camshaft adjuster according to claim 1, wherein the attachment elements are arranged in a direction of the longitudinal axis of the camshaft adjuster at least partially between axial end faces of the pressure spaces or of the drive wheel.

4. The camshaft adjuster according to claim 1, wherein the drive wheel is plastic, the outer rotor allocated to the drive wheel is metal, and at least one bearing surface of the outer rotor is formed with a metallic insert body, which is held in a carrier body made from plastic with a firmly bonded or positive fit.

5. The camshaft adjuster according to claim 4, wherein the metallic insert body is formed extending in the peripheral direction and forms, in addition to the bearing surface, a boundary of the pressure spaces.

6. The camshaft adjuster according to claim 5, wherein the attachment elements interact with reinforcement inserts of at least one of the toothed ring or a flange.

7. The camshaft adjuster according to claim 4, wherein the insert bodies and the carrier body are connected to each other with a firmly bonded fit through an injection molding process.

8. The camshaft adjuster according to claim 1, wherein the drive wheel is produced from a composite material.

9. The camshaft adjuster according to claim 1, wherein the inner rotor is formed with plastic and has at least one bearing surface made from metal connected to the inner rotor with a positive or firmly bonded fit.

10. The camshaft adjuster according to claim 1, wherein the drive wheel is formed with at least one of the toothed ring, a belt wheel, or at least one of a chain wheel made from plastic.

11. The camshaft adjuster according to claim 1, wherein the toothed ring is formed integrally with the brackets, the toothed ring with the brackets is formed with a composite material, and reinforcing material of the composite material is arranged in a region of the brackets.

* * * * *